United States Patent [19]

Agam

[11] Patent Number: 4,676,510

[45] Date of Patent: Jun. 30, 1987

[54] GAME PIECES

[76] Inventor: Orram Agam, 4 rue Charles Divry, Paris 75014, France

[21] Appl. No.: 820,939

[22] Filed: Jan. 21, 1986

[51] Int. Cl.[4] ..... A63F 9/20

[52] U.S. Cl. ..... 273/292

[58] Field of Search ..... 273/292, 293, 294, 295; 434/96

[56] References Cited

U.S. PATENT DOCUMENTS

| | | | |
|---|---|---|---|
| D. 138,177 | 7/1944 | Field | 273/303 X |
| 2,881,537 | 4/1959 | Dreman | 273/292 X |
| 3,592,474 | 7/1971 | O'Neil | 273/157 R |
| 3,948,525 | 4/1976 | Faintuch | 273/292 X |

FOREIGN PATENT DOCUMENTS

| | | | |
|---|---|---|---|
| 2119663 | 11/1983 | United Kingdom | 273/292 |

*Primary Examiner*—Anton O. Oechsle

*Attorney, Agent, or Firm*—Cohen, Pontani & Lieberman

[57] ABSTRACT

Each game piece of a set thereof has a surface which includes a predetermined plurality of positions defined at the same location on all of the game pieces, and a predetermined plurality of substantially identical indicia, each indicia being located at a selected one of the plural predetermined positions on the game piece surface to define thereon a pattern of the plural indicia. The location of plural indicia at selected ones of the predetermined positions on each game piece is such that each game piece bears on its surface a pattern of indicia unique from the pattern borne on each other game piece in the set.

61 Claims, 9 Drawing Figures

GAME PIECES

FIELD OF THE INVENTION

The present invention relates to games and, more particularly, to sets of game pieces, each game piece carrying a multiplicity of indicia arranged to define thereon a pattern having a particular relationship with the patterns defined on others of the game pieces in the set.

BACKGROUND OF THE INVENTION

It is not uncommon in the conduct of many games and similar recreational activities to employ indicia-bearing game pieces, as tiles, for a variety of purposes. Such tiles may, for example, constitute markers for maintaining a visual and/or tactile record of the then-current position, or status, or score of a player—such as in many known board-based games wherein each player's respective game piece is advanced along a playing surface path to provide running indication of position relative to the other participants. On the other hand, such tiles may comprise an integral part of a game—as in the well-known board game "Candy-Land" wherein the indicia-bearing game cards are randomly drawn by the players in turn and indicate how far each player's board marker is to be advanced, somewhat in the nature of the rolling of dice.

In still other arrangements, such tiles may in effect constitute the game itself, as where the game is defined by a set of rules governing the range of permitted user-initiated manipulations of the tiles; the game of dominos is an example of this third variety. It is presently contemplated that the game pieces of the present invention be primarily, although not necessarily exclusively, utilized in a game of this last type wherein a series of rules determines the propriety of specific game piece manipulations.

Traditional dominos, a popular game for young children, is comprised of a set of tiles, each bearing between one and six spots or dots on each of two halves of a rectangular tile surface. The first player places a tile on the playing surface, and each additional participant, in turn, places another tile into abutment with one already on the surface. Permissible placement of tiles on the playing surface is governed, however, by the limitation that the abutting portions of two adjacently-positioned tiles must match—i.e. bear the same number of dots. Each player begins the game with the same predetermined number of tiles and, should he be unable to play a matching tile during a turn, that player must draw an additional tile. The game ends when a participant plays his last tile—that player is the winner.

The game of dominos can prove to be an enjoyable and, at the same time, beneficial pastime for young children by fostering the development of both physical (e.g. eye-hand) coordination and intellectual processes (such as mental recognition of spatial relationships). However, the fun and challenge of dominos as a pastime diminish rapidly with experience and as the young child matures so that, at a fairly early age, the game is usually no longer sufficiently stimulating to merit the child's continued interest or attention. Although the prior art is replete with both domino-like games and with particular game tiles or pieces for use in a variety of applications, none provide the kind or degree of long term intellectual stimulation or level of difficulty required to satisfy an older child, much less an adult of normal aptitude.

OBJECTS OF THE INVENTION

It is accordingly the desideratum of the present invention to provide a set of indicia-bearing game tiles that can be used in the conduct of a game requiring a level of intellectual participation sufficient to challenge and maintain the interest of an individual of at least normal adult aptitude.

It is a particular object of the invention to provide such a set of tiles for use in a thought-provoking game in the playing of which a participant is stimulated in the development of cerebral abilities for recognizing relatively complex spatial relationships and distinctions.

It is a further object of the invention to provide such a set of game tiles wherein each tile bears indicia forming a pattern having a particular relationship with the patterns defined on others of the game pieces in the set.

It is another object of the invention to provide such a set of game tiles wherein each tile bears indicia forming a pattern different from the pattern formed on all other tiles in the set.

It is a still further object of the invention to provide multiple sets of game tiles bearing indicia-forming patterns and wherein each set conforms to one or mor criteria which govern the relationships and permissible similarities and differences between individual tiles in the set.

Further objects, features and advantages of the present invention will be more fully appreciated by reference to the following detailed description of presently preferred, but nonetheless illustrative, embodiments in accordance with the present invention when taken in conjunction with the accompanying drawing.

BRIEF DESCRIPTION OF THE DRAWING

In the drawing, wherein similar reference characters denote similar elements throughout the several rules.

DETAILED DESCRIPTION OF THE PREFERRED EMBODIMENT

The present invention concerns sets of game pieces or tiles, each tile bearing or carrying at selected ones of predetermined locations thereon a plurality of indicia defining a particular pattern on the tile, and primarily intended for use in playing a game. It should at the outset, however, be understood and appreciated that the use herein of the term "tile" should be construed in an illustrative and exemplary and nonlimiting sense as broadly denoting a carrier upon which a plurality of pattern-defining indicia are borne. In its intended context, the appearance herein of the denotation "tile" refers to any markers, cards, blocks, supports, game pieces or other physical elements —typically but not necessarily having a substantially planar surface or surface portion thereon—on which plural indicia are carried at a selected plurality of predetermined locations to define a pattern. The term "tile" herein is further meant to encompass non-physical representations of indicia-bearing elements such, for example, as computer simulations in which real or apparent or representational physical surfaces bearing the plural indicia are reproduced or simulated or otherwise modeled to appear on a video monitor or hard-copy printer or through some other output device or peripheral.

The present invention also concerns the relationships between the patterns defined by the locations of plural indicia carried on each of the various tiles in the set. Put another way, a particular set of tiles, in accordance with the invention, will include a plurality of tiles each bearing an indicia-defined pattern, and the respective patterns which appear on the different tiles in the set must meet certain rules or criteria. Thus, the broadest criteria may, by way of example, require that the pattern borne on each tile cannot duplicate the pattern on any other tile in the set. A narrower or sub-criteria might specify that all of the tiles observe rotational exclusivity—i.e. that the pattern or arrangement of indicia on each tile be unique even if one or more of the tiles are rotated by whole number multiples of 90° increments. As a consequence, numerous sets and subsets of tiles may be envisioned within the scope and contemplation of the invention by selecting or specifying the particular relationship-defining criteria or rules to be applied to the set.

The present invention accordingly lies both in the manner and arrangement of plural indicia on individual game tiles, and in the permitted or required relationships of the indicia-defining patterns carried on the various tiles constituting a set thereof. Moreover, although the inventive tiles are primarily intended for use in a game—the rules and conduct of which may vary within a wide range of options and scenarios—numerous other applications are within the intended scope of the invention as will hereinafter become apparent.

Figure 1:
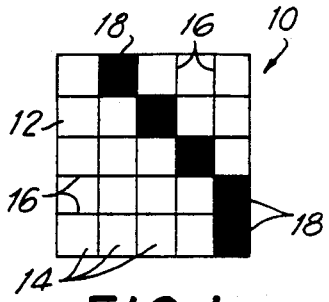
FIG. 1 is a face view of a game piece or tile in accordance with the present invention.

Turning now to the drawing, there is shown in FIG. 1 an indicia-bearing surface 12 of a typical game piece or tile in accordance with the invention and designated by the general reference numeral 10. Although tile 10 is illustrated in the drawing as being of apparent two-dimensional form, it is contemplated that it may in fact, or alternatively, be multi- (e.g. three) dimensional or, indeed, merely a computer or otherwise-generated simulation so long as tile 10, whatever its form, includes at least one surface or surface portion 12 upon which the plural indicia are arranged. Similarly, the tile or game piece 10 may incorporate a multiplicity of surfaces, each (or less than all) of which carries a particular pattern-defining plurality of indicia. The tile surface may also be sectioned into multiple partitions or areas, each of which bears a separate and, if desired, distinct indicia-defined pattern (somewhat in the manner of conventional domino tiles). It is further anticipated and expected that surface 12 will generally be substantially planar so that the pattern of indicia on the tile is rendered visible in use, although the preference for substantial planarity is subject to a wide range of modification and equivalence dependent upon the shape, nature, form and general characteristics of the tile.

Surface 12 includes a predetermined plurality of positions defined thereon and delineating potential or permitted locations for the indicia borne on surface 12 in accordance with the invention. It is preferred that all of the tiles 10 in a set of such tiles have the same predetermined number of plural positions on their surfaces 12, and further that all of the positions at which indicia are located on any tile 10 in a set be present on all other tiles in the set. In the embodiment of the invention herein disclosed, the predetermined plural positions consist of substantially contiguous fields 14 which, as arranged, form a grid-like array or grouping wherein contiguous fields 14 are separated by grid lines or delineators 16. Where, as in the disclosed tile 10, a grid defines the locations of fields 14, the delineator lines 16 may or may not, as a matter of design choice, visibly appear on surface 12; they are shown, for purposes of illustration and to facilitate full understanding of the disclosure, in FIG. 1 but not on the tiles depicted in FIG. 4. Of course, fields 14 need not be arranged to delineate a grid, and it should also be noted that although the illustrated grid of field positions forms a square—i.e. has an equal number of rows and columns—this characteristic is also a matter of design choice and not a strict requirement of the invention. Thus, such a grid arrangement may be quadrilateral or arcuate in overall configuration, and may have either regular or irregular boundaries as desired. In any event, the five-by-five (five rows, five columns) grid of the illustrated tile 10 defines twenty-five predetermined positions at which plural indicia may be selectively located in accordance with the invention.

Tile 10 carries, on its surface 12, a predetermined plurality of indicia individually and collectively identified by reference numeral 18. It is preferred and generally intended that all of the indicia 18 appearing on a particular tile 10 be identical in form and, in addition, that the indicia carried on all tiles 10 in a set be of the same form as well. Nonetheless, variations in the shading or coloration of indicia borne on the same tile or on different tiles should be understood as being within the scope and contemplation of the invention.

Indicia 18 may consist of, without limitation, any indications, figures, signs, characters, tokens, shadings colorations or markings by which their presence (or absence) at particular positions or fields 14 is determinable. In the presently disclosed embodiment, indicia 18 are defined by coloring or otherwise filling in substantially entire grid fields 14 at those positions at which the indicia are selectively located. Thus, indicia 18 are illustrated in the drawings as solid squares that are darkly shaded with respect to the lighter background shade or tint or color tone of tile surface 12. Those skilled in the art will readily recognize, however, that such depiction is by way of example only and should not be taken as a required limitation on the invention.

It is an important aspect of the invention that each tile 10 in a set of tiles bears the same predetermined number of indicia 18 on its surface 12. Furthermore, for reasons that will become evident as this description proceeds, the predetermined plurality or number of indicia 18 on each tile surface 12 must be less than the number of predetermined positions or fields 14 defined on the tile surface. The tiles 10 illustrated in the drawing, for example, each bear five indicia 18 positioned within a five-by-five grid-like array of twenty-five locationally predetermined fields 14. As there shown, the locating of each of the plural indicia 18 at a selected one of the plural predetermined fields 14 on tile surface 12 defines on the surface a pattern of, in the case of the disclosed and presently preferred embodiment, darkened or deeply shaded areas against the white or otherwise relatively lighter background of tile surface 12.

Figure 2A:
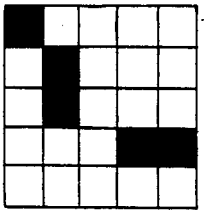
FIGS. 2A and 2B are face views of game pieces or tiles exhibiting particular indicia-defined patterns in accordance with the invention.
Figure 2B:
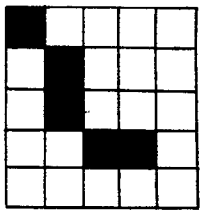

It is also preferred that the location of indicia 18 on the surface 12 of each tile 10 conform to the limitation that each indicia on the tile be disposed in a field that lies substantially adjacent to at least on other indicia-bearing field on that tile. Put another way, it is preferred that no indicia-bearing field 14 on a tile 10 be entirely surrounded by blank or empty fields; i.e. that at least one field lying adjacent to each indicia-bearing field itself incorporates an indicia 18 therewithin. The term "adjacent" is used here to denote substantial abutment of the fields in which two indicia are respectively located on a tile 10 and is intended to encompass both side-to-side and corner-to-corner abutment of fields 14. In any event, this preferred criterion of substantial adjacency dictates that the pattern defined on each tile 10 is continuous in the sense that such pattern forms in effect a single, unbroken "island" or land mass with respect to the background of surface 12 upon which the indicia appear, an effect most readily apparent in the disclosed form of tile 10 (wherein each indicia 18 fills an entire field 14) but of equal applicability where the indicia are for example discrete figures occupying an area smaller than the entire field. Thus, the tile-borne indicia illustrated in FIG. 2A do not meet the criterion of substantial adjacency—since the pattern thereby defined forms two, separated land areas—whereas the indicia of FIG. 2B define a single, continuous pattern and thus conform to the noted criterion.

The end result of requiring substantial adjacency is to appreciably limit the number of possible permutations of multiple indicia locations and the different patterns so defined on the game pieces or tiles. This limitation has been incorporated, to facilitate illustration and ease of description, in the set of tiles disclosed herein and constituting the currently preferred embodiment of the invention.

In addition to providing, in accordance with the foregoing description, plural indicia selectively located on a tile surface having a predetermined plurality of locationally-defined positions, a second essential aspect of the invention concerns the specific criteria which determine the permitted indicia-formed patterns borne on the various tiles constituting a set thereof. Those criteria express acceptable relationships between the patterns on individual tiles 10 of a set and may, for ease of discussion, be considered rules or principles governing the requisites and specifications of a particular set. Thus, in its broadest aspects the invention comprises a set of game pieces or tiles having the characteristics and attributes heretofore described and wherein all of the tiles are different from one another—i.e. each tile bears a unique pattern that appears only once in the set. The complete set of such tiles therefore includes all possible permutations or patterns of plural indicia attainable in accordance with the heretofore-enunciated requirements for the individual game pieces.

Those skilled in the art will appreciate that with even a relatively small number of indicia on each tile and a relatively limited matrix of available positions on the tile surface the number of different patterns meeting the foregoing criteria is extremely large so that, in the context of a game, us of the entire tile set may prove to be impractical. It is therefore advantageous and presently preferred that, in defining the set of tiles 10, additional criteria be imposed to create game piece subsets more readily adaptable for recreational and educational use in, for example, a participatory game.

Figure 3A:
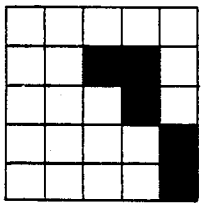
FIGS. 3A, 3B, 3C and 3D are face views of game pieces or tiles exhibiting particular indicia-defined patterns in accordance with the invention.
Figure 3B:
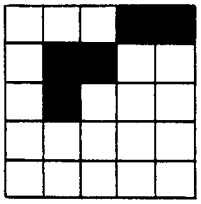

Two such criteria, each of which may be applied separately or jointly with the other in defining a subset of game tiles, relate to the uniqueness or exclusivity of each of the tile-borne patterns in the newly-limited set or subset. A first such criterion is rotational exclusivity—i.e. that each set tile 10 bears an indicia-defined pattern different from the patterns carried on all other tiles in the set even with rotation of one or more of the tiles by a whole-number multiple of 90 Degrees (90°). For example, although the tiles illustrated in FIGS. 3A and 3B bear different patterns of indicia they are not rotationally exclusive because clockwise rotation of the FIG. 3B tile through an angle of 90° yields the identical pattern seen on the FIG. 3A tile.

Imposition of the requirement of rotational exclusivity upon the game pieces or tiles 10 constituting the full set thereof has two significant and advantageous effects. First, it appreciably diminishes the number of patterns that can concurrently exist in the set while meeting all of the specifications and criteria governing the location of indicia on each tile and, as a consequence, reduces to more manageable proportions the number of tiles in the resulting set. Second, by requiring a player of a game involving the tiles to mentally consider, in his evaluation of some action or play being contemplated, the similarities and/or differences between the tile-borne patterns in a variety of rotational orientations, such rotational exclusivity adds a high degree of complexity to what might otherwise seem a relatively easy game and thereby enhances the mental stimulation involved in playing a game utilizing the inventive tiles 10.

Figure 3C:
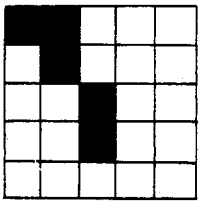
Figure 3D:
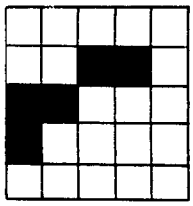

A second criterion which relates to defining the exclusivity or uniqueness of patterns displayed in the tile set —and which again may be applied either alone or jointly with the requirement for rotational exclusivity—is translational exclusivity. In this context, the term translational exclusivity is intended to denote that, for a given orientation of a tile 10, relative movement of its indicia-defined pattern to a position vertically and/or horizontally displaced along the tile surface 12 does not result in a changed or different pattern. Thus, and again referring to FIG. 3, the patterns on the tiles of FIGS. 3A and 3C lack translational exclusivity because a shift of the FIG. 3A pattern one position up and two positions to the left results in the pattern which appears on the FIG. 3C tile. And, as noted with respect to rotational exclusivity, imposition of translational exclusivity on the set of tiles both substantially reduces the number of tiles in the resulting set and adds complexity and interest to a game thus characterized by increased mental stimulation.

Those skilled in the art will recognize that, by concurrently applying the dual criteria of rotational and translational exclusivity, a set of game pieces of readily manageable proportion and size results. Even more significant than the notably reduced number of tiles in the resulting set, however, is the remarkable level of mental agility and skill required in the participatory conduct of a game utilizing a set of tiles wherein each tile bears a rotationally and translationally unique pattern. This can perhaps best be appreciated by considering, for example, that application of both rotational and translational exclusivity to the tile-borne patterns of FIGS. 3A and 3D renders them identical and, therefore, duplicative.

Figure 4:
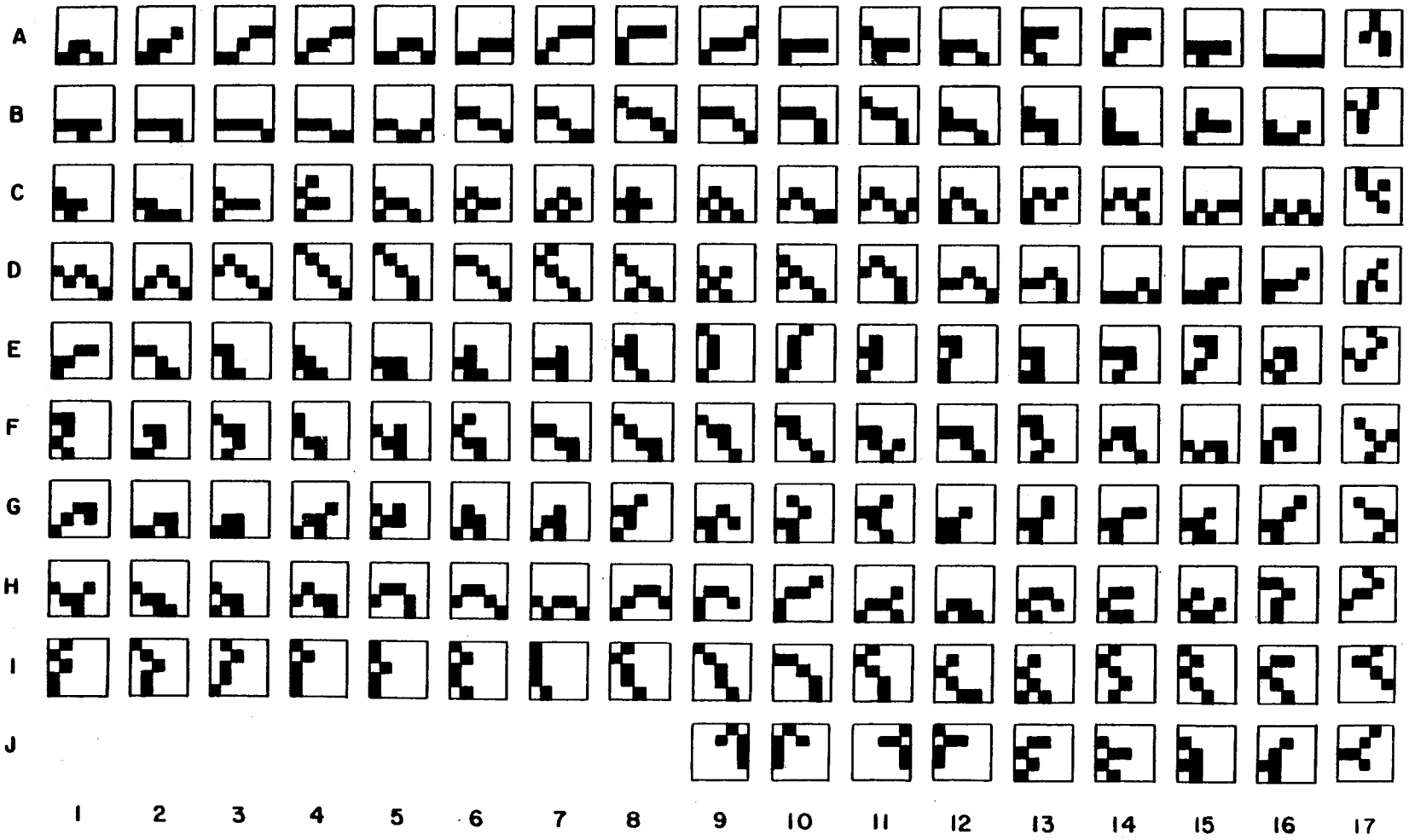
FIG. 4 is a preferred set of game pieces o tiles in accordance with the invention.

Depicted in FIG. 4 are 166 indicia-defined game piece patterns which are currently believed to consititute the complete set of all such patterns—i.e. all positional permutations of indicia 18 within the available array of twenty-five fields 14—meeting the various criteria, limitations and conventions thus far disclosed and comprising the currently preferred embodiment of the invention. Each of these 166 tiles exhibits the characteristic of substantial adjacency heretofore described and, with respect to the remainder of the set, satisfies the dual criteria of rotational and translational exclusivity. For descriptive convenience in hereafter identifying individual ones of the tiles shown in FIG. 4, the horizontal rows are delineated by the letters A through J and the columns by the numbers 1 through 17; thus, the tile 10 in the upper left-hand corner of FIG.4 may be denoted as tile or pattern A-1, and the tile in the lower right-hand corner thereof as tile or pattern J-17.

Numerous games utilizing the preferred set of tiles illustrated in FIG. 4—or any tile set defined in accordance with the invention—may be developed and will occur to those skilled in the art and having knowledge of this disclosure. A relatively simple game form may be patterned after conventional dominos and will now be described. However, it should be clearly understood that this description of the conduct of such a game utilizing the inventive tiles 10 is intended to be by way of example only and that far more complex and sophisticated game forms and rules are both contemplated and intended.

Thus, tiles 10 may be employed in a game wherein each participant initially receives a randomly-distributed proportionate share of the game pieces in the set. Each player, in turn, gets an opportunity to place one or more of his tiles onto the playing surface in conformity with the game rules governing tile placement. Prior to each such turn, the player rolls a die to determine the maximum number of tiles he may play during that turn, each such turn lasting a fixed period of time. The object of the game is to place all of one's tiles on the playing surface as quickly as possible and, in order to win, to be the first to do so.

Figure 5:
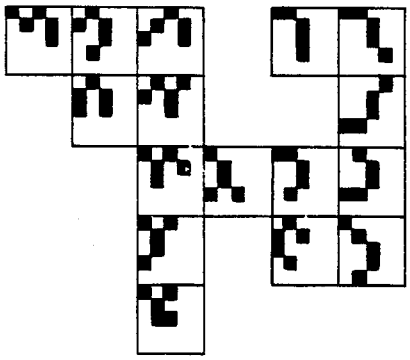
FIG. 5 illustrates the appearance of a sample playing surface at an early point in the conduct of a game using the tile set of FIG. 4.

As with the specific procedures relating to the mechanics of player participation, the rules governing proper placement of tiles on the playing surface or table may vary widely within the discretion and control of the participants. It is generally contemplated that, following placement of at least a first or starter tile on the table, each player may in turn place one or more of their tiles into juxtapositioning, edge-to-edge abutment with one or more tiles already played pursuant to the game rules. The primary rule of juxtapositional placement in the particular game herein disclosed by way of example requires that two properly abutting tiles must have only a single field of difference; i.e. the patterns borne on each of two abutting tiles 10 must have all but one of the indicia 18 located in the corresponding or positionally-equivalent fields 14. Referring once more to FIG. 4, it would therefore be acceptable to place tiles A-1 and A-2 into juxtapositional abutment, or tiles F-1 and F-2, or tiles H-5 and H-8, to identify but three of the many hundreds of such possible tile pairings. FIG. 5 depicts the appearance of a sample playing surface at an early point in the conduct of such a game.

It should now be evident to those conversant in the art that each of the tiles 10 in the preferred set illustrated in FIG. 4 is characterized by a single field of difference with at least one other tile in the set. As a consequence, numerous subsets of those tiles may be defined by, for example, limiting the subset to tiles having a predetermined number, more than one, of fields of difference, or by requiring that the differently-located indicia represent a positional shift of only a single adjacent field. Similarly, the principal rule for placement of tiles on the playing surface may be modified in many ways including a more flexible requirement that, for permitted abutment of tiles, a first predetermined number of the indicia on each abutting tile pair must be identically located and a second predetermined number of the indicia be disposed at different field positions.

It is also contemplated that many additional and/or substitute criteria may be imposed, within the intended scope of the invention, both on the characteristics and configuration of the individual tiles and on the criteria affecting the tiles properly forming a set or subset thereof. It has been previously indicated that three-dimensionally constructed game pieces may have a multiplicity of surfaces, all or some of those surfaces bearing a plurality of selectively located pattern-defining indicia in predetermined positional fields. Each such surface, moreover, may be partitioned into multiple areas each carrying a separate and distinct indicia-formed pattern. Color variations —of the individual indicia, or of the background surface, or of the resulting pattern, or of some combination(s) thereof—may also be employed as secondary criteria for, by way of example, determining pattern exclusivity within a particular set of tiles and as affecting the rules and conduct of the game.

Yet another criterion that may be applied to the tiles in identifying those game pieces properly belonging to a set thereof concerns the elimination of mirror image or reflected or complementary patterns. Application of this additional exclusion or limitation to the preferred set illustrated in FIG. 4 would further diminish the number of member tiles by those which, in addition to exhibiting rotational and translational exclusivity, are merely mirror images of patterns already present in the set. Examples of reflected or mirror image pairs in FIG. 4 are tiles A-3 and B-7, A-4 and B-6, and A-15 and B-1; one tile of each of those pairs would be eliminated from the set in implementing this further criterion. Adoption of the non-mirror image criterion to the resulting tile set may prove particularly appropriate where the game pieces are computer simulated, and the game played, on a video display terminal having the capability of optically rotating the displayed tile out of the plane of the display.

There have accordingly been herein disclosed novel game pieces or tiles, and sets and subsets thereof, for use in the conduct of a game. Participation in games constructed around or otherwise utilizing the inventive tiles should prove both entertaining and educational to players of all ages and levels of intelligence and sophistication. Moreover, by reason of the nature and teachings of the invention, such games necessarily stimulate intellectual development through play and enhance the participants' cerebral abilities in the recognition and identification of spatial relational differences.

Finally, while there have been shown and described and pointed out fundamental novel features of the invention as applied to preferred embodiments thereof, it will be understood that various omissions and substitutions and changes in the form and details of the structures illustrated and taught and in their use may be made by those skilled in the art without departing from the spirit of the invention. It is the intention, therefor, to be limited only as indicated by the scope of the claims appended hereto.

What is claimed is:

1. A set consisting of a plurality of game pieces, each said game piece comprising:

surface means for bearing visible indicia and including at least a predetermined plurality of positions defined on said surface means, the predetermined number of said plural positions being the same on all said plural game pieces, and said plural predetermined positions on each said game piece being defined by a grid defining twenty-five predetermined positions defined on said surface means in a five-by-five arrangement;

a predetermined plurality of substantially identical indicia, said predetermined plurality of indicia being less than the number of said plural predetermined positions defined on said surface means, and each of said plural indicia being located at a selected one of said plural predetermined positions to define on said game piece surface means a pattern of said plural indicia, said plural indicia comprising five substantial identical indicia located at selected ones of said predetermined positions so that each game piece bears on said surface means thereof a pattern of said plural indicia unique from the pattern borne on each other game piece, and each said plural indicia on each game piece being located substantially adjacent to at least one other indicia on said game piece to define a substantially continuous pattern on said game piece.

2. A set of game pieces in accordance with claim 1, wherein said plural indicia are selectively located at said predetermined positions so that said unique pattern of plural indicia borne on each game piece is rotationally unique with respect to each other game piece of the set.

3. A set of game pieces in accordance with claim 1, wherein said plural indicia are selectively located at said predetermined positions so that said unique pattern of plural indicia borne on each game piece is translationally unique with respect to each other game piece of the set.

4. A set of game pieces in accordance with claim 1, wherein said plural indicia are selectively located at said predetermined positions so that said unique pattern of plural indicia borne on each game piece is rotationally and translationally unique with respect to each other game piece of the set.

5. A set of game pieces in accordance with claim 1, wherein said set includes plural game pieces bearing unique patterns constituting all positional permutations of said plural indicia locations.

6. A set of game pieces in accordance with claim 5, wherein said plural indicia are selectively located at said predetermined positions so that said unique pattern of plural indicia borne of each game piece is rotationally unique with respect to each other game piece of the set.

7. A set of game pieces in accordance with claim 5, wherein said plural indicia are selectively located at said predetermined positions so that said unique pattern of plural indicia borne on each gam piece is translationally unique with respect to each other game piece of the set.

8. A set of game pieces in accordance with claim 5, wherein said plural indicia are selectively located at said predetermined positions so that said unique pattern of plural indicia borne on each game piece is rotationally and translationally unique with respect to each other game piece of the set.

9. A set of game pieces in accordance with claim 1, wherein said plural indicia are selectively located at said predetermined positions so that, on each said game piece, each said plural indicia is located abuttingly adjacent to at least one other of said indicia.

10. A set of game pieces in accordance with claim 9, wherein said plural indicia are selectively located at said predetermined positions so that said unique pattern of plural indicia borne on each game piece is rotationally unique with respect to each other game piece of the set.

11. A set of game pieces in accordance with claim 9, wherein said plural indicia are selectively located at said predetermined positions so that said unique pattern of plural indicia borne on each game piece is translationally unique with respect to each other game piece of the set.

12. A set of game pieces in accordance with claim 9, wherein said plural indicia are selectively located at said predetermined positions so that said unique pattern of plural indicia borne on each game piece is rotationally and translationally unique with respect to each other game piece of the set.

13. A set of game pieces in accordance with claim 1, wherein the difference between the pattern of plural indicia borne on any one of said game pieces and the pattern on at least one other game piece of said set is defined by a change of location of exactly one of said plural indicia from one said position to another.

14. A set of game pieces in accordance with claim 1, wherein said surface means on each said game piece has a first color tone, and each said plural indicia on said game piece is defined by a second color tone substantially filling said position, said first and second color tones being sufficiently contrasting so that said indicia are readily visibly distinct from said surface means.

15. A set of game pieces in accordance with claim 14, wherein said plural predetermined positions on each said game piece are defined by a grid defined on said surface means.

16. A set of game tiles in accordance with claim 1, wherein each said game piece is an at least two dimensional body and said surface means comprises a face thereon.

17. A set of game pieces in accordance with claim 1, a first predetermined number of said plural indicia on each game piece being located at the same predetermined positions on all said game tiles of the set and a second predetermined number of said plural indicia on each game piece being located at different ones of said predetermined positions on each other game piece in the set.

18. A set of game pieces in accordance with claim 1, wherein said surface means is substantially planar.

19. A set consisting of a plurality of game pieces, each said game piece comprising:

surface means for bearing visible indicia and including at least a predetermined plurality of positions defined on said surface means, the predetermined number of said plural positions being the same on all said plural game pieces;

a predetermined plurality of at least 3 substantially identical indicia, said predetermined plurality of indicia being less than the number of said plural predetermined positions defined on said surface means, and each of said plural indicia being located at a selected one of said plural predetermined positions to define on said game piece surface means a pattern of said plural indicia, said plural indicia being selectively located at said predetermined positions so that each game piece bears on said surface means thereof a pattern of said plural indicia unique from the pattern borne on each other game piece, and each said plural indicia on each game piece being located substantially adjacent to at least one other indicia on said game piece to define a substantially continuous pattern on said game piece, and said plural indicia being selectively located at said predetermined positions so that said unique pattern of plural indicia borne on each game piece is rotationally and translationally unique with respect to each other game piece of the set.

20. A set of game pieces in accordance with claim 19, wherein each of said plural predetermined positions comprises a field on each said game piece.

21. A set of game pieces in accordance with claim 20, wherein each of said fields on each said game piece is substantially contiguous with at least another of said fields on the game piece.

22. A set of game pieces in accordance with claim 19, wherein said plural predetermined positions on eaoh said game piece are defined at the same locations on all said game pieces.

23. A set of game pieces in accordance with claim 19, wherein said plural predetermined positions on each said game piece are defined by a grid defined on said surface means.

24. A set of game pieces in accordance with claim 23, wherein said grid is bounded by a substantially rectangular contour.

25. A set of game pieces in accordance with claim 24, wherein the same number of said predetermined positions are defined along each border of the substantially rectangular contour bounding said grid to thereby define a substantially square arrangement of said plural positions on each said game piece.

26. A set of game pieces in accordance with claim 23, wherein said grid defines twenty-five predetermined positions defined in a five-by-five arrangement.

27. A set of game pieces in accordance with claim 26, wherein each said game piece bears five substantially identical indicia located at selected ones of said predetermined positions.

28. A set of game pieces in accordance with claim 19, wherein said plural indicia are selectively located at said predetermined positions so that, on each said game piece, each said plural indicia is located abuttingly adjacent to at least one other of said indicia.

29. A set of game pieces in accordance with claim 19, wherein the difference between the pattern of plural indicia borne on any one of said game pieces and the pattern on at least one other game piece of said set is defined by a change of location of exactly one of said plural indicia from one said position to another.

30. A set of game pieces in accordance with claim 19, wherein said surface means on each said game piece has a first color tone, and each said plural indicia on said game piece is defined by a second color tone substantially filling said position, said first and second color tones being sufficiently contrasting so that said indicia are readily visibly distinct from said surface means.

31. A set of game pieces in accordance with claim 30, wherein said plural predetermined positions on each said game piece are defined by a grid defined on said surface means.

32. A set of game tiles in accordance with claim 19, wherein each said game piece is an at least two dimentional body and said surface means comprises a face thereon.

33. A set of game pieces in accordance with claim 19, a first predetermined number of said plural indicia on each game piece being located at the same predetermined positions on all said game tiles of the set and a second predetermined number of said plural indicia on each game piece being located at different ones of said predetermined positions on each other game piece in the set.

34. A set of game pieces in accordance with claim 19, wherein each said game piece bears five substantially identical indicia located at selected ones of said predetermined positions.

35. A set of game pieces in accordance with claim 19, wherein said surface means is substantially planar.

36. A set consisting of a plurality of game pieces, each said game piece comprising:

surface means for bearing visible indicia and including at least a predetermined plurality of positions defined on said surface means, the predetermined number of said plural positions being the same on all said plural game pieces;

a predetermined plurality of at least 3 substantially identical indicia, said predetermined plurality of indicia being less than the number of said plural predetermined positions defined on said surface means, and each of said plural indicia being located at a selected one of said plural predetermined positions to define on said game piece surface means a pattern of said plural indicia, said plural indicia being selectively located at said predetermined positions so that each game piece bears on said surface means thereof a pattern of said plural indicia unique from the pattern borne on each other game piece, and each said plural indicia on each game piece being located substantially adjacent to at least one other indicia on said game piece to define a substantially continuous pattern on said game piece, the difference between the pattern of plural indicia borne on any one of said game pieces and the pattern on at least one other game piece of said set being defined by a change of location of exactly one of said plural indicia from one said position to another.

37. A set of game pieces in accordance with claim 36, wherein each said game piece bears five substantially identical indicia located at selected ones of said predetermined positions.

38. A set of game pieces in accordance with claim 36, wherein said plural indicia are selectively located at said predetermined positions so that said unique pattern of plural indicia borne on each game piece is rotationally unique with respect to each other game piece of the set.

39. A set of game pieces in accordance with claim 36, wherein said plural indicia are selectively located at said predetermined positions so that said unique pattern of plural indicia borne on each game piece is translationally unique with respect to each other game piece of the set.

40. A set of game pieces in accordance with claim 36, wherein said plural indicia are selectively located at said predetermined positions so that said unique pattern of plural indicia borne on each game piece is rotationally and translationally unique with respect to each other game piece of the set.

41. A set of game pieces in accordance with claim 36, wherein said set includes plural game pieces bearing unique patterns constituting all positional permutations of said plural indicia locations.

42. A set of game pieces in accordance with claim 41, wherein said plural indicia are selectively located at said predetermined positions so that said unique pattern of plural indicia borne on each game piece is rotationally unique with respect to each other game piece of the set.

43. A set of game pieces in accordance with claim 41, wherein said plural indicia are selectively located at said predetermined positions so that said unique pattern of plural indicia borne on each game piece is translationally unique with respect to each other game piece of the set.

44. A set of game pieces in accordance with claim 41, wherein said plural indicia are selectively located at said predetermined positions so that said unique pattern of plural indicia borne on each game piece is rotationally and translationally unique with respect to each other game piece of the set.

45. A set of game pieces in accordance with claim 36, wherein said plural indicia are selectively located at said predetermined positions so that, on each said game piece, each said plural indicia is located abuttingly adjacent to at least one other of said indicia.

46. A set of game pieces in accordance with claim 45, wherein said plural indicia are selectively located at said predetermined positions so that said unique pattern of plural indicia borne on each game piece is rotationally unique with respect to each other game piece of the set.

47. A set of game pieces in accordance with claim 45, wherein said plural indicia are selectively located at said predetermined positions so that said unique pattern of plural indicia borne on each game piece is translationally unique with respect to each other game piece of the set.

48. A set of game pieces in accordance with claim 45, wherein said plural indicia are selectively located at said predetermined positions so that said unique pattern of plural indicia borne on each game piece is rotationally and translationally unique with respect to each other game piece of the set.

49. A set of game pieces in accordance with claim 36, wherein each of said plural predetermined positions comprises a field on each said game piece.

50. A set of game pieces in accordance with claim 49, wherein each of said fields on each said game piece is substantially contiguous with at least another of said fields the game piece.

51. A set of game pieces in accordance with claim 36, wherein said plural predetermined positions on each said game piece are defined at the same locations on all said game pieces.

52. A set of game pieces in accordance with claim 36, wherein said plural predetermined positions on each said game piece are defined by a grid defined on said surface means.

53. A set of game pieces in accordance with claim 52, wherein said grid is bounded by a substantially rectangular contour.

54. A set of game pieces in accordance with claim 53, wherein the same number of said predetermined positions are defined along each border of the substantially rectangular contour bounding said grid to thereby define a substantially square arrangement of said plural positions on each said game piece.

55. A set of game pieces in accordance with claim 52, wherein each said grid defines twenty-five predetermined positions defined in a five-by-five arrangement.

56. A set of game pieces in accordance with claim 55, wherein each said game piece bears five substantially identical indicia located at selected ones of said predetermined positions.

57. A set of game pieces in accordance with claim 36, wherein said surface means on each said game piece has a first color tone, and each said plural indicia on said game piece is defined by a second color tone substantially filling said position, said first and second color tones being sufficiently contrasting so that said indicia are readily visible distinct from said surface means.

58. A set of game pieces in accordance with claim 57, wherein said plural predetermined positions on each said game piece are defined by a grid defined on said surface means.

59. A set of game tiles in accordance with claim 36, wherein each said game piece is an at least two dimensional body and said surface means comprises a face thereon.

60. A set of game pieces in accordance with claim 36, a first predetermined number of said plural indicia on each game piece being located at the same predetermined positions on all said game tiles of the set and a second predetermined number of said plural indicia on each game piece being located at different ones of said predetermined positions on each other game piece in the set.

61. A set of game pieces in accordance with claim 36, wherein said surface means is substantially planar.

* * * * *